United States Patent [19]

Henzel

[11] Patent Number: 4,965,238

[45] Date of Patent: Oct. 23, 1990

[54] THERMAL DYE TRANSFER RECEIVING ELEMENT WITH SUBBING LAYER FOR DYE IMAGE-RECEIVING LAYER

[75] Inventor: Richard P. Henzel, Webster, N.Y.

[73] Assignee: Eastman Kodak Company, Rochester, N.Y.

[21] Appl. No.: 449,628

[22] Filed: Dec. 11, 1989

[51] Int. Cl.[5] ..... B41M 5/035; B41M 5/26

[52] U.S. Cl. ..... 503/227; 8/471; 428/195; 428/480; 428/522; 428/523; 428/704; 428/913; 428/914

[58] Field of Search ..... 8/471; 428/195, 480, 428/522, 523, 704, 913, 914

[56] References Cited

U.S. PATENT DOCUMENTS

| | | | |
|---|---|---|---|
| 4,720,480 | 1/1988 | Ito et al. | 503/227 |
| 4,737,486 | 4/1988 | Henzel | 503/227 |
| 4,748,150 | 5/1988 | Vanier et al. | 503/227 |
| 4,753,921 | 6/1988 | Henzel | 8/471 |
| 4,774,224 | 9/1988 | Campbell | 503/227 |
| 4,814,321 | 3/1989 | Campbell | 503/227 |

*Primary Examiner*—Bruce H. Hess

*Attorney, Agent, or Firm*—Andrew J. Anderson

[57] ABSTRACT

A dye-receiving element for thermal dye transfer includes a polyolefin support, a polymeric dye image-receiving layer, and a polymeric subbing layer having an inorganic backbone which is an oxide of zirconium between the polyolefin support and the dye image-receiving layer which provides improved adhesion.

20 Claims, No Drawings

THERMAL DYE TRANSFER RECEIVING ELEMENT WITH SUBBING LAYER FOR DYE IMAGE-RECEIVING LAYER

This invention relates to dye-receiving elements used in thermal dye transfer, and more particularly to the use of a subbing layer between the support and a polymeric dye image-receiving layer to improve the adhesion of the dye image-receiving layer to the support.

In recent years, thermal transfer systems have been developed to obtain prints from pictures which have been generated electronically from a color video camera. According to one way of obtaining such prints, an electronic picture is first subjected to color separation by color filters. The respective color separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

U.S. Pat. Nos. 4,774,224 and 4,814,321 of Campbell and 4,748,150 of Vanier et al disclose dye-receiving elements for thermal dye transfer comprising polyethylene coated supports having thereon a subbing layer of a vinylidene chloride copolymer and a polymeric dye image-receiving layer.

While the use of such vinylidene chloride copolymer subbing layers improves the adhesion of the dye image-receiving layer to polyethylene coated supports, it has been found that adhesion to other polyolefins such as polypropylene is not as good. Also, even in the case of polyethylene, in some instances where the use of vinylidene chloride copolymers gives apparently acceptable initial adhesion, adhesion after thermal transfer of a dye image is poor.

U.S. Pat. Nos. 4,737,486 and 4,753,921 disclose the use of polymers having an inorganic backbone which is an oxide of zirconium as subbing layers in a dye-donor element, but do not suggest the need for or use of such materials as a subbing layer in a dye-receiving element.

It would be desirable to provide a thermal dye transfer dye-receiving element which would have good adhesion between a polymeric dye image-receiving layer and polyolefin coated supports, including both polyethylene and polypropylene coated supports, and good adhesion both before and after being subjected to a thermal printing process.

These and other objects are achieved in accordance with this invention which comprises a dye-receiving element for thermal dye transfer comprising a polyolefin support and having thereon a subbing layer comprising a polymer having an inorganic backbone which is an oxide of zirconium, and a polymeric dye image-receiving layer.

The subbing layer polymer of the invention may be formed from an organic zirconate, such as neopentyl(-diallyloxy) tri(N-ethylenediamino)ethyl zirconate (Kenrich Petro Chemical, Bayonne, N.J.) or a zirconium alkoxide. In a preferred embodiment of the invention, the subbing layer polymer is formed from a zirconium alkoxide, such as zirconium tetra-n-propoxide or zirconium acetonyl-acetonate. The zirconium alkoxides are believed to undergo hydrolysis at varying rates to form a cross linked inorganic polymer.

The subbing layer of the invention may be employed at any concentration which is effective for the intended purpose. In general, good results have been obtained at from about 0.005 to about 1.0 g/m$^2$ of the coated zirconium compound.

Many materials are known for use as the polymeric dye image-receiving layer of thermal dye transfer receiving elements such as polycarbonates, polyurethanes, polyesters, polyvinyl chloride, poly(styrene-co-acrylonitrile), poly(caprolactone), other polyesters, and mixtures thereof. The dye image receiving layer may be present in any amount which is effective for the intended purpose. In general, good results are obtained at a concentration of from about 1 to about 5 g/m$^2$.

In a preferred embodiment of the invention, the dye image-receiving layer comprises a polyester, such as poly(caprolactone), or a vinylchloride-vinylacetate copolymer.

The polyolefin support for the dye-receiving element of the invention may comprise a polyolefin monolayer, or may comprise a substrate bearing a polyolefin layer. In a preferred embodiment, a paper substrate support bearing a polypropylene containing layer is used. In a further preferred embodiment, a paper substrate support bearing a layer comprising a mixture of polypropylene and polyethylene is used. Such supports are the subject matter of copending, commonly assigned U.S Ser. No. 449,630 of Mruk et al., filed Dec. 11, 1989; the disclosure of which is incorporated by reference. The polyolefin layer on the paper support is generally applied at a thickness of from about 10 to about 100 $\mu$m, preferably about 20 to about 50 $\mu$m. Synthetic supports having a polyolefin layer may also be used. Preferably, the polyolefin layer of the support is subjected to corona discharge treatment prior to being coated with the subbing layer of the invention.

The corona discharge treatment that is used for the polyolefin support can be carried out in an apparatus such as described in U.S. Pat. Nos. 2,864,755, 2,864,756, 2,910,723 and 3,018,189. Advantageously, the polyolefin support is subjected to a corona discharge of from about 0.1 to about 3.5 rfa. For example, a 60-cycle Lepel high frequency generator operating at 6 kva. at 440 volts giving an output of 2.5 RF amps can be used with several metal electrodes close to the support at a point where it passes over a metal roll coated with a dielectric material. Similarly, a metal roller may be used to support the web with the other electrode array being in planetary disposition equidistant from the surface of the metal roller and each being coated with a dielectric at least on the surface nearest the metal roller. For further details, reference is made to U.S. Pat. No. 3,412,908, the disclosure of which is hereby incorporated by reference.

A dye-donor element that is used with the dye-receiving element of the invention comprises a support having thereon a dye layer. Any dye can be used in such a layer provided it is transferable to the dye image-receiving layer of the dye-receiving element of the invention by the action of heat. Especially good results have been obtained with sub limable dyes. Examples of sublimable dyes include anthraquinone dyes, e.g., Sumikalon Violet RS ® (product of Sumitomo Chemical Co., Ltd.), Dianix Fast Violet 3R FS ® (product of Mitsubishi Chemical Industries, Ltd.), and Kayalon Polyol Brilliant Blue N BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (Product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

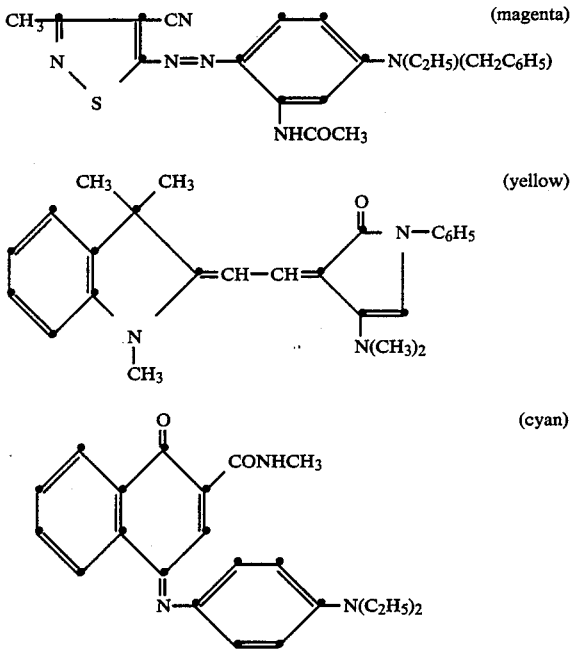

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

A dye-barrier layer comprising a hydrophilic polymer may also be employed in the dye-donor element between its support and the dye layer which provides improved dye transfer densities. Such dye-barrier layer materials include those described and claimed in U.S. Pat. No. 4,700,208 of Vanier et al, issued Oct, 13, 1987.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, phosphoric acid esters, silicone oils, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(styrene-co-acrylonitrile), poly(vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

As noted above, dye-donor elements are used to form a dye transfer image. Such a process comprises image-wise-heating a dye-donor element and transferring a dye image to a dye-receiving element as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

This example shows that zirconium alkoxide derived subbing layers are more effective in bonding polyolefin surfaced supports to poly(caprolactone) receiving layers compared to prior art vinylidene chloride polymer subbing layers.

Two different polyolefin paper supports were used for dye-transfer receivers, one was polyethylene derived, the other was predominately polypropylene containing 20% polyethylene.

A 5.3 mil (135 μm) thick paper stock mixture of hardwood and softwood bleached pulp was extrusion overcoated by methods well-known in the art with either a blend of high and low density polyethylene pigmented with 9% titanium dioxide at a total layer coverage of 17 g/m$^2$ (thickness 19 μm) or with a blend of 20% low density polyethylene, 75% crystalline polypropylene, and 5% Penn. Ind. Chem. Piccotex 120 (copolymer of α-methylstyrene, m-vinyltoluene and p-vinyltoluene) pigmented with 9% titanium dioxide at a total layer coverage of 44 g/m$^2$ (thickness 50 μm).

Zirconium alkoxides of the invention were coated at the indicated level from n-propyl or ethyl alcohol on top of each of the polyethylene (PE) or Polypropylene-derived (PP) paper supports. Before each subbing layer was coated, the support was subjected to corona discharge treatment at approximately 450 Joules/m$^2$. On top of each subbing layer a dye-receiving layer of Union Carbide:Tone PCL-300 poly(caprolactone) (3.2 g/m$^2$), 3M Corp.:FC-431 (a perfluorinated alkylsulfonamidoalkyl ester) (0.022 g/m$^2$), and Dow Corning:DC-510 Silicone Fluid (0.016 g/m$^2$), was coated from methylene chloride.

A comparison subbing layer (C2) of poly(acrylonitrile-co-vinylidene chloride-co-acrylic acid) (14/79/7 wt ratio) (0.16 g/m$^2$) was coated as described above from a butanone and cyclopentanone solvent mixture. Each subbing layer was then overcoated with a receiving layer as described above.

(Receiver Polymer Structure is:

(R1): Poly(Caprolactone)

$\leftarrow O(CH_2)_5CO \rightarrow_n$ Union Carbide: Tone PCL-300

Zirconium alkoxides of the invention are:

(B1): Aldrich Chemical Co.:zirconium acetonylacetonate $Zr(CH(COCH_3)_2)_4$ (B2): Alpha Products, Inc.:zirconium tetra-n-propoxide $Zr(OCH_2CH_2CH_3)_4$ Each receiver was subjected to a tape adhesion test. The receiver surface was first carefully scored in an "X" pattern. A small area (approximately ¾ inch×2 inch) of 3M Corp. Scotch® Magic Transparent Tape was firmly pressed by hand over the scored area of the receiver surface leaving enough area free to serve as a handle for pulling the tape. Upon manually pulling the tape, ideally none of the receiver layer would be removed. Receiver layer removal indicated a weak bond between the polyolefin coated paper support and the receiver layer. The tape test was repeated on the same area if necessary.

Receivers that appeared to show excellent adhesion on the as-coated material were subjected to a thermal printing process using separate cyan, magenta and yellow dye-donors and were again subjected to the tape test described above.

The following categories were established:

E—excellent (no layer removal even after repeated tries with the tape test—in some instances subbing layer bond may be so strong that tearing occurs at paper/olefin interface)

F—fair (partial layer removal)

P—poor or unacceptable (substantial or total layer removal)

V—variable (sometimes extensive layer removal occurred, repeated tests were not consistent suggesting non-uniform adhesion over somewhat large areas.

X—receiver layer separated from paper support during printing, thus no tape test could be run.

nd—not determined.

The data below show that the zirconium alkoxide derived subbing layers of the invention gave improved adhesive characteristics when used as a subbing layer for polypropylene supports overcoated with a polycaprolactone dye-receiving layer compared to the prior art or comparison subbing layers, both before and after printing. The zirconium alkoxide derived subbing layers gave excellent adhesion with both polyethylene and polypropylene coated paper stock.

| | | Tape Test | |
|---|---|---|---|
| Subbing Layer | Support | Initial | After Printing |
| None (control) (C1) | PP | P | V |
| Vinylidene chloride (C2) (0.16 g/m$^2$) | PP | P | V |
| Zirconium acetylacetonate (B1) (0.16 g/m$^2$) | PP | E | E |
| Zirconium propoxide (B2) | | | |
| (0.005 g/m$^2$) | PP | E | E |
| (0.022 g/m$^2$) | PP | E | E |
| (0.054 g/m$^2$) | PP | E | E |

-continued

| Subbing Layer | Support | Tape Test Initial | Tape Test After Printing |
|---|---|---|---|
| (0.16 g/m$^2$) | PP | E | E |
| (0.32 g/m$^2$) | PP | E | E |
| (0.54 g/m$^2$) | PP | E | E |
| None (control) (C1) | PE | P | V |
| Vinylidene chloride (C2) (0.16 g/m$^2$) | PE | E | E |
| Zirconium acetylacetonate (B1) (0.16 g/m$^2$) | PE | E | E |
| Zirconium propoxide (B2) (0.16 g/m$^2$) | PE | E | E |

EXAMPLE 2

This example shows that zirconium alkoxide derived subbing layers are effective for bonding polyethylene and polypropylene surfaces to a variety of receiver layers. Other receiver polymers, in addition to poly(caprolactone), such as other polyesters and copolymers of vinylchloride-vinyl acetate, also showed improved adhesion.

Paper supports with a polypropylene (PP) or polyethylene (PE) extrusion layer were coated with a subbing layer of zirconium propoxide (0.16 g/m$^2$) and were then overcoated similar as described in Example 1 with the indicated dye receiver polymer (3.2 g/m$^2$).

Comparison and control subbing layers were coated as in Example 1 (0.16 g/m$^2$). Each layer was then overcoated with a receiving layer as described in Example 1. Each receiver was subjected to a tape test as described in Example 1 for adhesion evaluation.

Receiver polymers coated were:

R2: Toyobo KK:Vylon 200

Synthetic polyester resin.

R3: A bisphenol-A polycarbonate modified with 50 mole % to 3-oxa-1,5-pentanediol

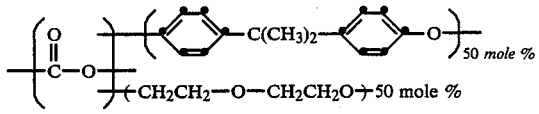

R4: A bisphenol-A polycarbonate

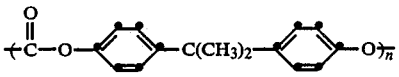

Makrolon 5700

R5: A bisphenol-A polycarbonate modified with 50 mole % 1,5-pentanediol (Tg=64° C.)

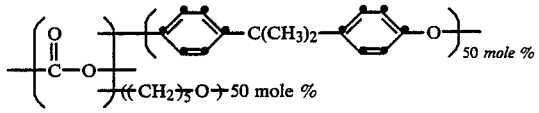

R6: Polystyrene

R6: Polystyrene

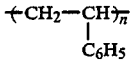

R7: Scientific Polymer Products: No. 070 Poly(vinylchloride-co-vinyl acetate-co-maleic acid) (81:17:2 wt ratio)

R6: Scientific Polymer Products: No. 070 Poly(vinylchloride-co-vinyl acetate-co-maleic acid) (81:17:2 wt ratio)

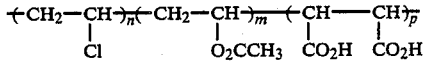

The data below show that zirconium alkoxide derived subbing layers are effective for bonding vinyl chloride and polyester receiving layers to polyolefin interfaces.

| Subbing Layer | Receiver Polymer | Support | Tape Test Initial | Tape Test After Printing |
|---|---|---|---|---|
| None (control) (C1) | R2 | PP | P | nd |
| Vinylidene chloride (C2) | R2 | PP | P | nd |
| Zirconium alkoxide (B2) | R2 | PP | E | nd |
| None (control) (C1) | R3 | PP | P | P |
| Vinylidene chloride (C2) | R3 | PP | P | P |
| Zirconium alkoxide (B2) | R3 | PP | V | E |
| None (control) (C1) | R4 | PP | P | P |
| Vinylidene chloride (C2) | R4 | PP | P | P |
| Zirconium alkoxide (B2) | R4 | PP | P | P |
| None (control) (C1) | R3 + R4* | PP | P | P |
| Vinylidene chloride (C2) | R3 + R4* | PP | P | P |
| Zirconium alkoxide (B2) | R3 + R4* | PP | V | P |
| None (control) (C1) | R5 | PP | P | nd |
| Vinylidene chloride (C2) | R5 | PP | P | nd |
| Zirconium alkoxide (B2) | R5 | PP | P | nd |
| None (control) (C1) | R6 | PP | P | nd |
| Vinylidene chloride (C2) | R6 | PP | F | nd |
| Zirconium alkoxide (B2) | R6 | PP | P | nd |
| None (control) (C1) | R7 | PP | P | X |
| Vinylidene chloride (C2) | R7 | PP | F | X |
| Zirconium alkoxide (B2) | R7 | PP | E | E |
| None (control) (C1) | R3 | PE | P | P |
| Vinylidene chloride (C2) | R3 | PE | E | E |
| Zirconium alkoxide (B2) | R3 | PE | P | P |
| None (control) (C1) | R4 | PE | P | P |
| Vinylidene chloride (C2) | R4 | PE | E | E |
| Zirconium alkoxide (B2) | R4 | PE | P | P |
| None (control) (C1) | R3 + R4* | PE | P | P |
| Vinylidene chloride (C2) | R3 + R4* | PE | E | E |
| Zirconium alkoxide (B2) | R3 + R4* | PE | F | P |
| None (control) (C1) | R7 | PE | E | X |
| Vinylidene chloride (C2) | R7 | PE | E | E |
| Zirconium alkoxide (B2) | R7 | PE | E | F |

*Each at 1.6 g/m$^2$, for a total coverage of 3.2 g/m$^2$

The above results demonstrate the effectiveness of the subbing layer of the invention in bonding dye image-receiving layers to polyolefin supports, especially supports bearing a polypropylene containing layer, and the effectiveness of such subbing layers both before and after the dye-receiving element is subjected to a thermal printing process.

The invention has been described in detail with particular reference to preferred embodiments thereof, but it will be understood that variations and modifications can be effected within the spirit and scope of the invention.

What is claimed is:

1. In a dye-receiving element for thermal dye-transfer comprising:

(a) a polyolefin support;

(b) a polymeric dye image-receiving layer; and (c) a subbing layer between said polyolefin support and said dye image-receiving layer; the improvement wherein said subbing layer comprises a polymer having an inorganic backbone which is an oxide of zirconium.

2. The element of claim 1, wherein the subbing layer polymer is formed from an organic zirconate.

3. The element of claim 1, wherein the subbing layer polymer is formed from a zirconium alkoxide.

4. The element of claim 1, wherein the subbing layer polymer is formed from zirconium tetra-n-propoxide.

5. The element of claim 1, wherein the subbing layer polymer is formed from zirconium acetonyl-acetonate.

6. The element of claim 1, wherein the support comprises a substrate bearing a polypropylene containing layer.

7. The element of claim 6, wherein the dye image-receiving layer comprises a polyester.

8. The element of claim 6, wherein the dye image-receiving layer comprises poly(caprolactone).

9. The element of claim 6, wherein the dye image-receiving layer comprises a vinylchloride-vinylacetate copolymer.

10. The element of claim 6, wherein the subbing layer polymer is formed from a zirconium alkoxide.

11. The element of claim 6, wherein the dye image-receiving layer contains a thermally-transferred dye image.

12. The element of claim 1, wherein the dye image-receiving layer contains a thermally-transferred dye image.

13. In a process of forming a dye transfer image comprising imagewise-heating a dye-donor element comprising a support having thereon a dye-containing layer and thereby transferring a dye image to a dye-receiving element to form said dye transfer image, said dye receiving element comprising a polyolefin support having thereon a polymeric dye image-receiving layer and a subbing layer between said polyolefin support and said dye image-receiving layer, the improvement wherein said subbing layer comprises a polymer having an inorganic backbone which is an oxide of zirconium.

14. The process of claim 13, wherein the dye-receiving element support comprises a substrate bearing a polypropylene containing layer.

15. The process of claim 13, wherein the dye image-receiving layer comprises a polyester or a vinylchloride-vinylacetate copolymer.

16. The process of claim 13, wherein the subbing layer polymer is formed from a zirconium alkoxide.

17. In a thermal dye transfer assemblage comprising:

(a) a dye-donor element comprising a support having thereon a dye-containing layer; and (b) a dye-receiving element comprising (i) a polyolefin support, (ii) a polymeric dye image-receiving layer, and (iii) a subbing layer between the polyolefin support and the dye image-receiving layer, said dye-receiving element being in a superposed relationship with said dye-donor element so that said dye-containing layer is in contact with said dye image-receiving layer, the improvement wherein said subbing layer comprises a polymer having an inorganic backbone which is an oxide of zirconium.

18. The assemblage of claim 17, wherein the dye-receiving element support comprises a substrate bearing a polypropylene containing layer.

19. The assemblage of claim 17, wherein the dye image-receiving layer comprises a polyester or a vinylchloride-vinylacetate copolymer.

20. The assemblage of claim 17, wherein the subbing layer polymer is formed from a zirconium alkoxide.

* * * * *